US006913371B2

(12) United States Patent
Ping

(10) Patent No.: US 6,913,371 B2
(45) Date of Patent: Jul. 5, 2005

(54) SWIVEL FLASHLIGHT

(75) Inventor: Qiu Jian Ping, Hangzhou (CN)

(73) Assignee: Great Neck Saw Manufacturers, Inc., Mineola, NY (US)

( * ) Notice: Subject to any disclaimer, the term of this patent is extended or adjusted under 35 U.S.C. 154(b) by 0 days.

(21) Appl. No.: 10/685,036

(22) Filed: Oct. 14, 2003

(65) Prior Publication Data

US 2005/0078476 A1 Apr. 14, 2005

(51) Int. Cl.[7] ..... F21L 4/00
(52) U.S. Cl. ..... 362/199; 362/197; 362/427
(58) Field of Search ..... 362/197, 199, 362/427

(56) References Cited

U.S. PATENT DOCUMENTS

| | | | | |
|---|---|---|---|---|
| 699,546 | A | | 5/1902 | Merritt |
| 1,689,382 | A | | 10/1928 | Eaton |
| 1,699,927 | A | | 1/1929 | Stearns |
| 1,807,129 | A | | 5/1931 | Nuckolls |
| 1,863,151 | A | | 6/1932 | Barber |
| 1,899,868 | A | | 2/1933 | Herlbauer |
| 2,040,423 | A | | 5/1936 | Barber |
| D113,400 | S | | 2/1939 | Ritter |
| 2,205,163 | A | | 6/1940 | Blau |
| 2,401,366 | A | | 6/1946 | Muldoon |
| 2,539,974 | A | | 1/1951 | Riddell |
| 2,796,516 | A | | 6/1957 | Martschik |
| 4,196,821 | A | | 4/1980 | Teti, Jr. |
| 4,432,042 | A | | 2/1984 | Zeller |
| 4,447,863 | A | | 5/1984 | Fenne |
| 4,464,707 | A | | 8/1984 | Forrest |
| 4,466,664 | A | | 8/1984 | Kondou |
| 4,495,550 | A | | 1/1985 | Visciano |
| 4,533,982 | A | | 8/1985 | Kozar |
| 4,586,113 | A | | 4/1986 | Tsuyama |
| 4,706,331 | A | | 11/1987 | Compton |
| 4,739,457 | A | | 4/1988 | Orr |
| 4,782,435 | A | | 11/1988 | Manzoni |
| 4,937,713 | A | | 6/1990 | Holt et al. |
| 4,949,928 | A | | 8/1990 | Hoshino |
| 4,974,130 | A | | 11/1990 | Friedman |
| 5,119,280 | A | | 6/1992 | Yang |
| 5,355,746 | A | | 10/1994 | Lin |
| 5,410,457 | A | | 4/1995 | Parker |
| 5,541,822 | A | * | 7/1996 | Bamber ..... 362/427 |
| 5,988,828 | A | | 11/1999 | Prince et al. |
| 5,993,022 | A | | 11/1999 | Neyer et al. |
| 6,012,824 | A | | 1/2000 | Sharrah et al. |
| D445,925 | S | | 7/2001 | Parker |
| 6,457,841 | B1 | | 10/2002 | Lynch et al. |
| D468,850 | S | | 1/2003 | Sharrah et al. |
| D476,437 | S | | 6/2003 | Dalton et al. |
| D477,102 | S | | 7/2003 | Yuen |

FOREIGN PATENT DOCUMENTS

| | | |
|---|---|---|
| DE | 327882 | 10/1920 |
| DE | 522078 | 3/1931 |

* cited by examiner

*Primary Examiner*—Stephen F Husar
(74) *Attorney, Agent, or Firm*—Joseph J. Previto

(57) ABSTRACT

A flashlight having a handle and a head pivotally mounted on the handle. A bulb within the head and a battery within the handle in electrical circuit with a bulb in the head. The handle having an upstanding ear and the head having an extending arm. An opening in the upstanding ear and an opening in the arm, pivot means mounted in the openings so that the head can pivot relative to the ear and the handle.

21 Claims, 5 Drawing Sheets

SWIVEL FLASHLIGHT

BACKGROUND

The present invention relates to flashlights and more particularly to flashlights having a head that swivels relative to the handle.

Such swivel flashlights have been well known in the industry for a number of years. However, some of these flashlights have complicated mechanisms for moving the head from side to side and for holding the head in a predetermined position. Other of such swivel flashlights have complicated mechanisms for electrically connecting the battery to the bulb. Still others are expensive to manufacture and assemble.

Objects

The present invention overcomes these difficulties and has for one its objects the provision of an improved flashlight that has a head which swivels relative to the handle.

Another object of the present invention is the provision of an improved flashlight that has improved means for holding the swivel head in a predetermined position.

Another object of the present invention is an improved flashlight which has simple circuitry to connect the battery to the bulb.

Another object of the present invention is the provision of an improved flashlight which is inexpensive to manufacture and assemble.

Another object of the present invention is the provision of an improved flashlight which is simple to use.

Other and further objects of the invention will be obvious upon an understanding of the illustrative embodiment about to described, or will be indicated in the appended claims and various advantages not referred to herein will occur to one skilled in the art upon employment of the invention in practice.

DRAWINGS

A preferred embodiment of the invention has been chosen for purposes of illustration and description and is shown in the accompanying drawings forming a part of the specification, wherein.

Figure 1:
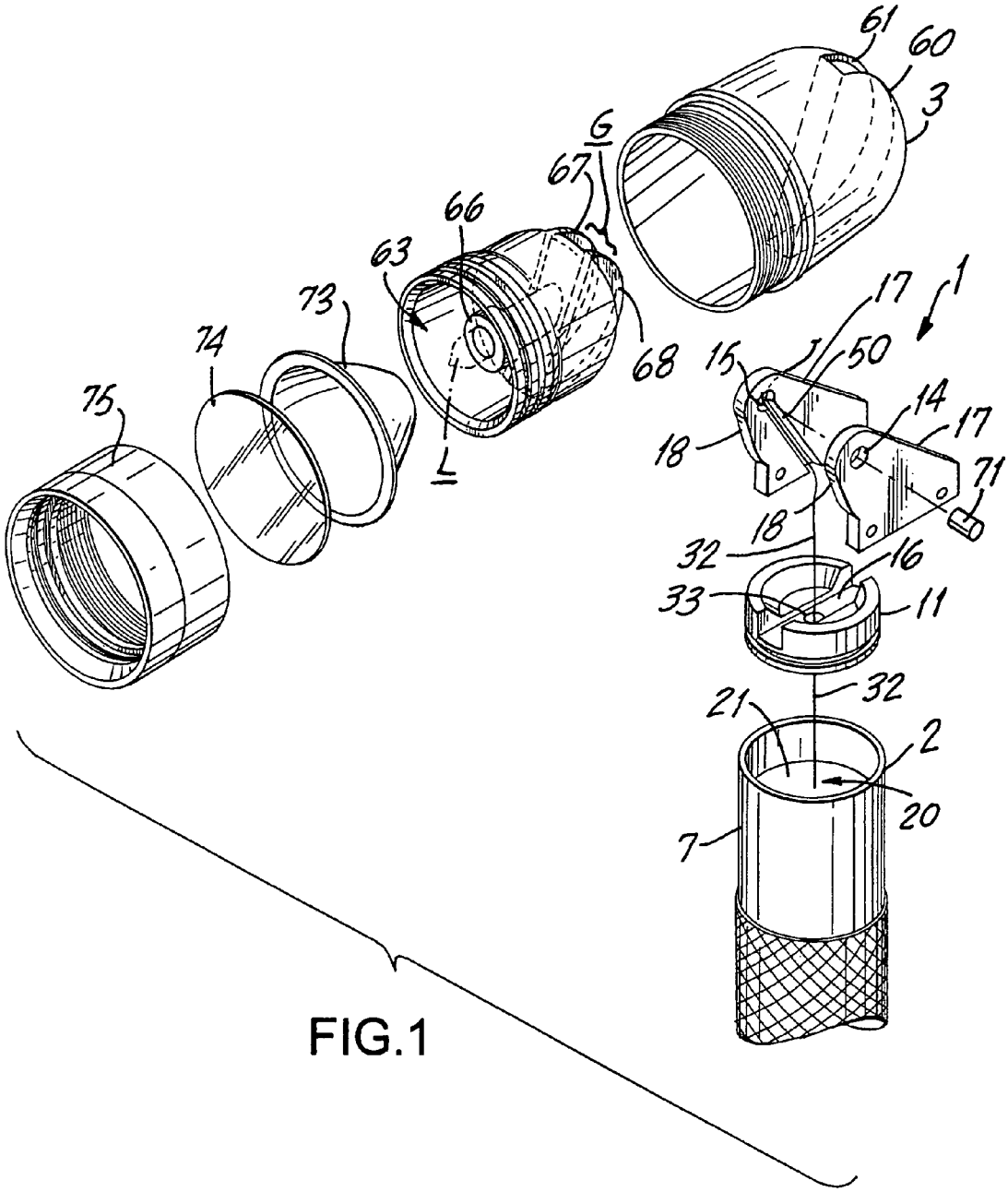
FIG. 1 is an exploded view showing the flashlight of the present invention.
Figure 2:
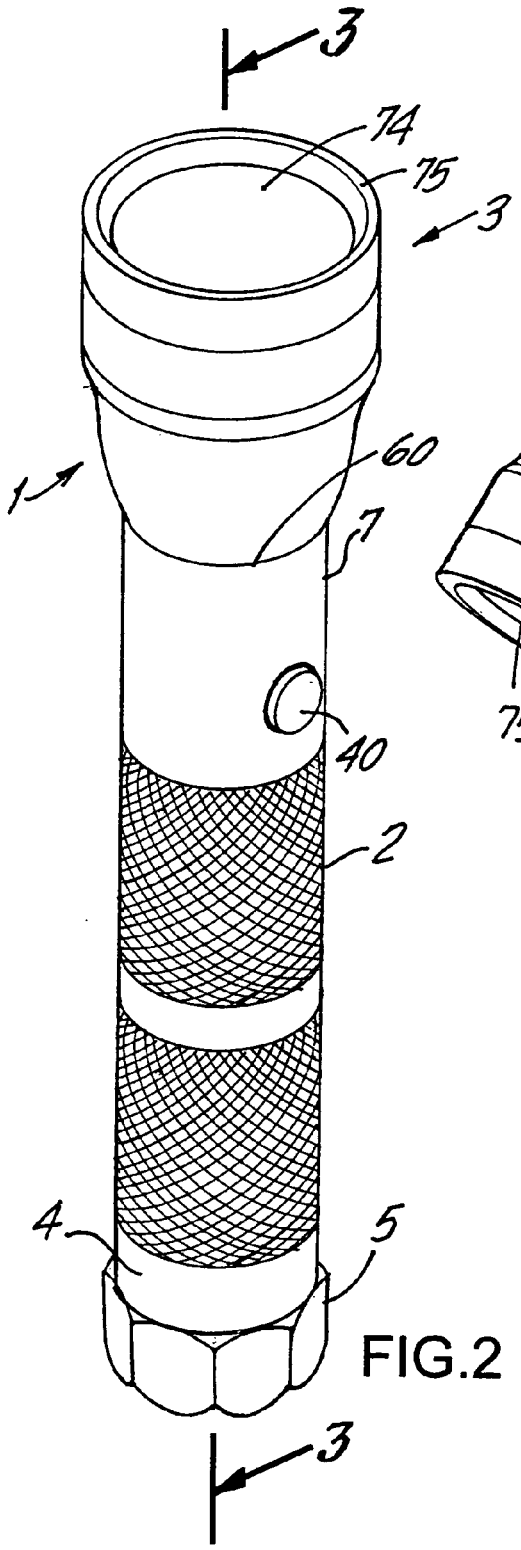
FIG. 2 is a perspective view of the flashlight of the present invention.
Figure 2A:
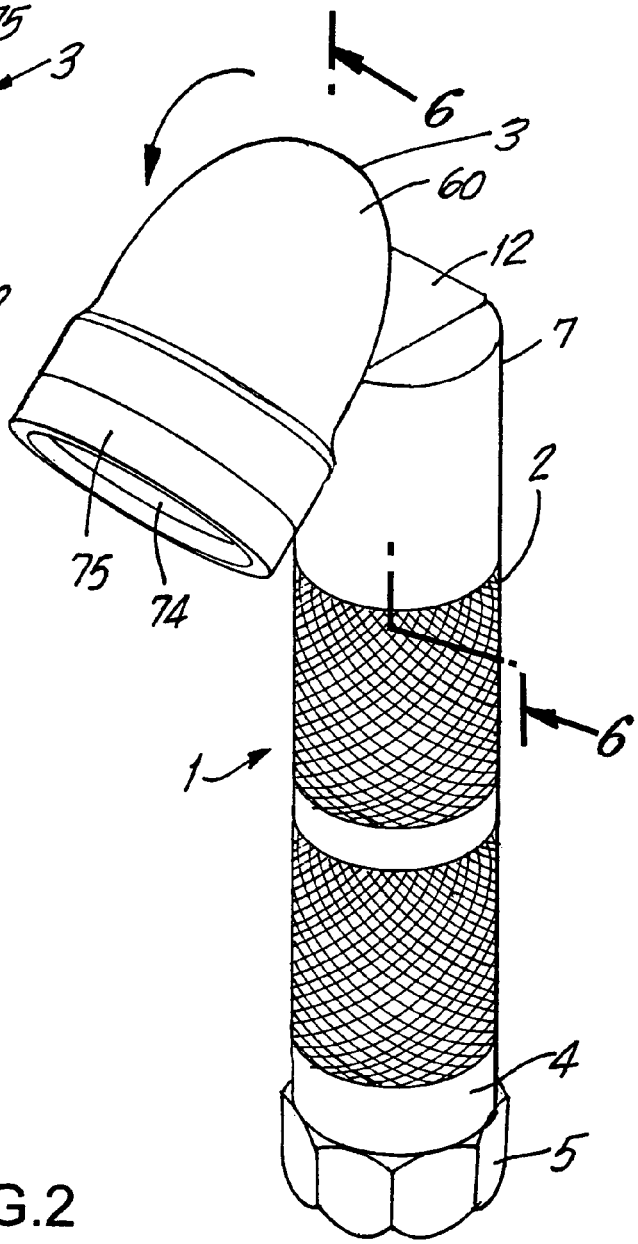

FIG. 2*a* is a perspective view similar to FIG. 2 showing the head in a folded position.

Figure 3:
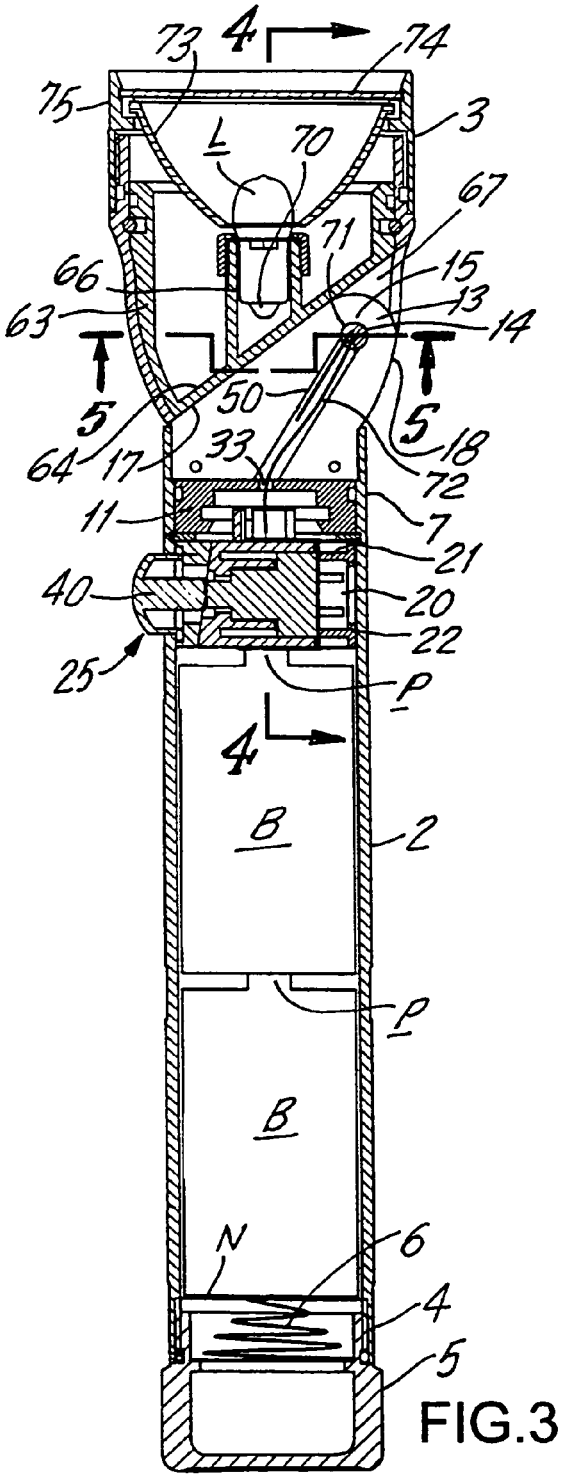

FIG. 3 is a sectional view taken along line 3—3 of FIG. 2.

Figure 4:
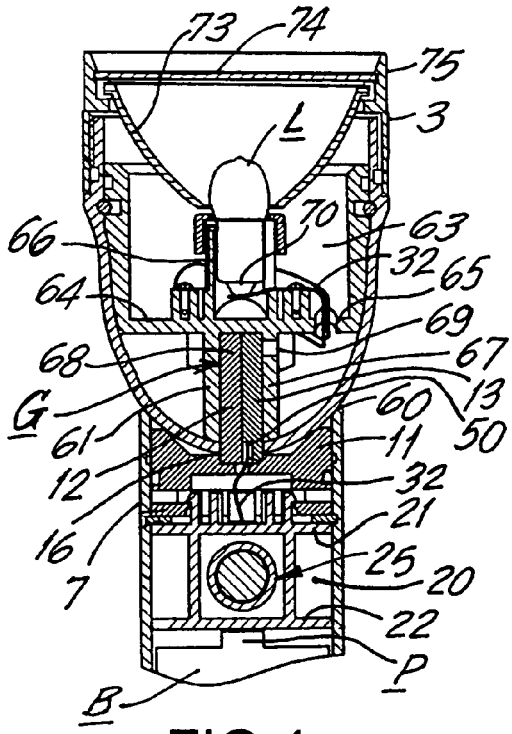

FIG. 4 is a sectional view taken along line 4—4 of FIG. 3.

Figure 5:
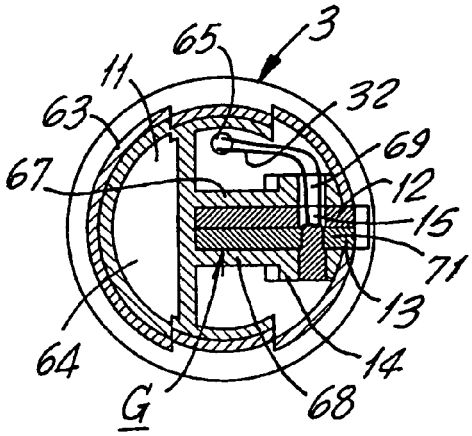

FIG. 5 is a sectional view taken along line 5—5 of FIG. 3.

Figure 6:
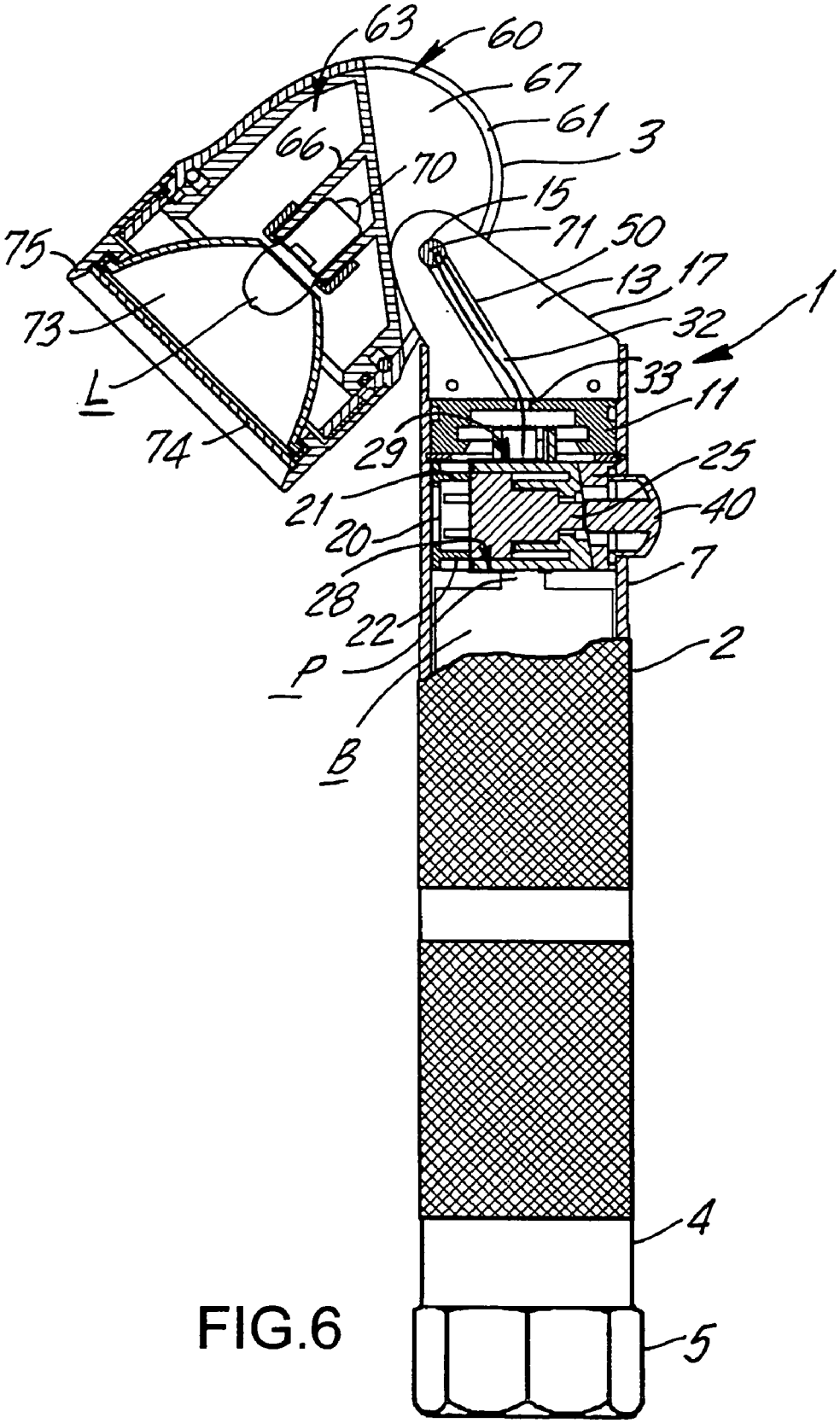

FIG. 6 is a sectional view taken along line 6—6 of FIG. 2*a*.

Figure 7:
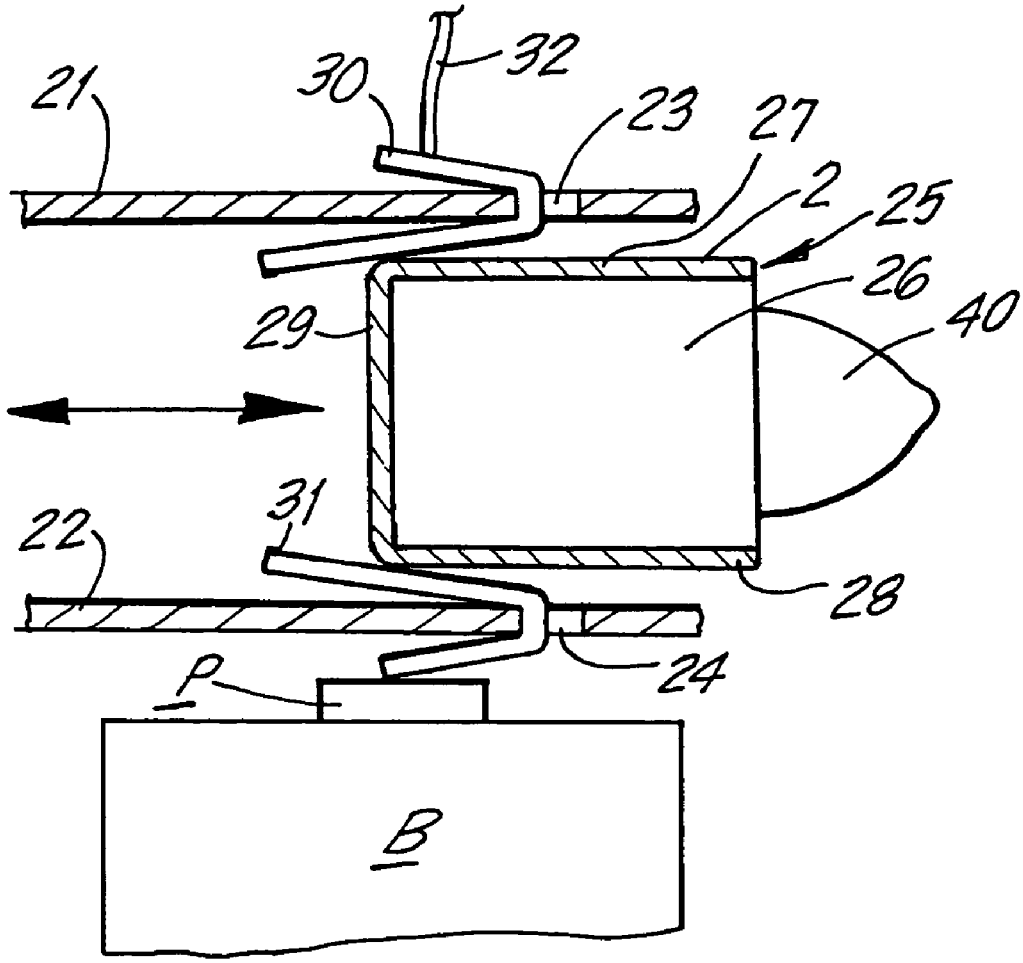

FIG. 7 is a simplified schematic view of the control switch used to switch the flashlight on and off.

DESCRIPTION

Referring to the drawings, the flashlight 1 of the present invention comprises a hollow handle 2 and a head 3 pivotally mounted thereon. The handle 2 is elongated and is preferably made of aluminum; however, the handle 2 may also be made of other materials, if desired. The lower end 4 of the handle has an end cap 5 threadably mounted thereon. A spring 6 is mounted in the end cap 5 of the hollow handle 3. The upper end 7 of the hollow handle 2 has a top cap 11 and a pair of ears 12 and 13 extending upwardly therefrom. The ears 12 and 13 are flat, thin and preferably in close contact or adjacency with each other. The ears 12 and 13 are rigidly mounted in a groove 16 in the top cap 11. The ears 12 and 13 have openings 14 and 15, respectively, at their upper ends which are in alignment with each other. Preferably the ears 12 and 13 have inclined front ends 17 and curved rear ends 18. A pair of batteries B having negative and positive terminals N and P, respectively, are mounted within the hollow handle 2 with the spring 6 pressing against the negative terminal N thereof to push the batteries B upwardly. Although two batteries B are shown in the drawings, it will be understood that the hollow handle 2 may be contoured to receive a single battery, if desired.

A switch assembly 20 is provided between the battery B and the top cap 11. Although the switch assembly 20 shown is the preferred switch assembly, other switch assemblies may be used, if desired. The switch assembly 20 has upper and lower walls 21 and 22 with upper and lower openings 23 and 24 therein, respectively. A push button assembly 25 is reciprocatably mounted in the switch assembly 20 and comprises a contact carrier 26 having upper and lower carrier contacts 27 and 28, respectfully, connected together by a wall contact 29. Upper and lower spring contacts 30 and 31 extend through the upper and lower openings 23 and 24, respectively, in the upper and lower walls 21 and 22. The lower spring contact 31 is in circuit with the positive terminal P of the battery B. The upper spring contact 30 has a connecting wire 32 extending upwardly therefrom which passes through an opening 33 in the top cap 11. The push button assembly 25 has a finger knob 40 connected to the contact carrier 26. When the finger knob 40 is pushed in, the battery positive terminal P is placed in circuit with the wire 32 through lower spring contact 31, lower and upper carrier contacts 28 and 27, respectively, wall contact 29 in the contact carrier 26, and the upper spring contact 30. When the finger knob 40 is moved out, the contact carrier 26 is moved away from the upper and lower spring contacts 30 and 31 and the circuit is broken.

The wire 32 extends upwardly from the upper spring contact 30 through the opening 33 in the top cap 11. One of the ears 13 has a channel 50 therein communicating with the opening 33 in the top cap 11 through which the wire 32 extends. The wire 32 passes through opening 33 and lies along the length of the channel 50 in the ear 13. Since the other ear 12 is in contact or close adjacency with the ear 13, the channel 50 is closed or covered by the ear 12 so that the wire 32 is held in place in channel 50. The wire 32 then extends and passes through the opening 15 in the upper end of the ear 13.

The head 3 has a curved rear end 60 having a narrow rear opening 61 which is wide enough to receive the two ears 12–13 snuggly therein. The head 60 has a reflective portion 73, a transparent cover 74 and a cap 75 that is threadably mounted onto the head 60. The head 3 has a bulb chamber 63 which fits snugly within the head 60 and which has an inclined lower wall 64 which is inclined at an angle similar to the angle of incline of the front ends 17 of the ears 12–13. Hence, when the head 3 is in the unfolded position, the lower wall 64 rests on the inclined front ends 17 of the ears 12–13. An opening 65 is provided in the lower wall 64 of the bulb chamber 63 through which the wire 32 passes. The lower wall 64 of the bulb chamber 63 has a pair of spaced arms 67–68 depending therefrom. The arms 67–68 are spaced apart from each other to form a gap G which is wide enough to receive the ears 12 and 13 snugly therein. The gap G is approximately the same width as the width of the rear opening 61 in the head 3. One of the arms 67 has an opening 69 therein through which wire 32 extends. Thus, the wire 32 extends along the ear channel 50 through the opening 15 in the ear 13, through the opening 69 in the arm 67 and through the opening 65 in the lower wall 64 and comes into contact with the positive side 70 of a bulb holder L.

As indicated above, the gap G between opposed arms 67 and 68 has the same width as the opening 61 in rear end 60 so that the ears 12–13 fit snugly and frictionally therein. Hence, when the head 3 is tilted relative to the handle 2 the friction between ears 12–13 and opening 61 and arms 67–68 will hold the head 3 in place. A pivot pin 71 extends through at least the opening 14 in the ear 13 and the opening 69 in arm 68 and partially into the opening 15 in the other ear 12. This permits the head 3 to pivot relative to the handle 2.

When the flashlight is turned on, the finger button 40 is pushed inwardly and a circuit is closed from the battery positive P through the lower spring contact 31, the lower and upper carrier contacts 28—28, wall contact 29, upper spring contact 30, the wire 32 and the positive bulb terminal P. The negative side of the bulb L is in circuit in the negative battery terminal N through the aluminum walls of the handle 2, the head 3, the rear wall 64 of the bulb chamber 63 and the bulb holder 55.

If it is desired to tilt the head 3, it is merely necessary to pivot the head 3 around the pivot pin 71. The friction between the gap G in the spaced arms 67–68 and the ears 12–13 is strong enough to permit the frictional force to keep the head 3 in its tilted position, but not strong enough to prevent the head 3 from tilting relative to the handle 2.

It will thus be seen that the present invention provides an improved flashlight that has a head which swivels relative to the handle, has improved means for holding the swivel head in a predetermined position, which has simple circuitry to connect the battery to the bulb, which is inexpensive to manufacture and assemble and which is simple to use.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A flashlight comprising a handle and a head assembly pivotally mounted on said handle, means for mounting a bulb within the head assembly, said handle adapted to receive a battery, circuit means adapted to create an electrical circuit between a battery in said handle and a bulb in the head assembly whereby a bulb can be turned on and off, said handle having an upstanding ear assembly, said head assembly having an arm assembly extending from a portion thereof, an opening in said upstanding ear assembly and an opening in said arm assembly, pivot means mounted in the said openings in said upstanding ear assembly and said arm assembly whereby said head can pivot relative to said upstanding ear and to said handle, said arm assembly comprises a pair of spaced arms and wherein said upstanding ear assembly is mounted between said spaced arms.

2. A flashlight as set forth in claim 1 upstanding ear assembly width is substantially equal to the space between said arms whereby the upstanding ear assembly is frictionally engaged between the spaced arms.

3. A flashlight as set forth in claim 2 wherein said head assembly comprises a bulb chamber and wherein said spaced arms extend from the bulb chamber.

4. A flashlight as set forth in claim 3 wherein the bulb chamber has a bottom wall wherein said spaced arms extend from said bottom wall.

5. A flashlight as set forth in claim 4 wherein said head assembly comprises a head and wherein said bulb chamber is mounted within said head.

6. A flashlight as set forth in claim 5 wherein said head has a rear wall and wherein said rear wall has a slot therein.

7. A flashlight as set forth in claim 6 wherein said slot has the same width as the distance between the spaced arms.

8. A flashlight as set forth in claim 7 wherein said circuit means comprises a switch assembly adapted to turn a bulb on and off.

9. A flashlight as set forth in claim 8 wherein connecting wire means extend from said switch assembly into said head and into electrical circuit with a bulb.

10. A flashlight as set forth in claim 9 wherein the opening in the arm assembly comprises an opening in at least one of said arms whereby said wire means passes through the openings in the ear assembly and said arm.

11. A flashlight as set forth in claim 10 wherein said ear assembly has a channel therein communicating with the opening in said ear assembly and wherein said wire means lies along said channel.

12. A flashlight as set forth in claim 10 wherein said ear assembly comprises a pair of ears which are mounted between said spaced arms and wherein said channel is in one of said spaced ears.

13. A flashlight as set forth in claim 12 wherein the other of said spaced ears covers said channel.

14. A flashlight as set forth in claim 13 wherein said bottom wall has an opening therein and wherein said wire means extends through said opening.

15. A flashlight as set forth in claim 14 wherein said spaced ears are in contact with each other.

16. A flashlight as set forth in claim 15 wherein the bottom wall of the bulb chamber is inclined.

17. A flashlight as set forth in claim 16 wherein the front edges of the said ears are inclined and wherein the incline of said bottom-wall is the same as the incline of the front edges of said ears.

18. A flashlight comprising a handle and a head assembly pivotally mounted on said handle, means for mounting a bulb within the head assembly, said handle adapted to receive a battery, circuit means adapted to create an electrical circuit between a battery in said handle and a bulb in the head assembly whereby a bulb can be turned on and off, said handle having an upstanding ear assembly, said head assembly having an arm assembly extending from a portion thereof, an opening in said upstanding ear assembly and an opening in said arm assembly, pivot means mounted in the said openings in said upstanding ear assembly and said arm assembly whereby said head can pivot relative to said upstanding ear and to said handle, said circuit means comprising a switch assembly adapted to turn a bulb on and off, said arm assembly comprises a pair of spaced arms.

19. A flashlight as set forth in claim 18 wherein said ear assembly comprises spaced ears in contact with each other and mounted between said spaced arms.

20. A flashlight as set forth in claim 19 wherein the said head assembly comprises an inclined bottom wall and wherein said spaced arms extend from said inclined bottom wall.

21. A flashlight as set forth in claim 20 wherein the said ears comprises inclined front edges and wherein the incline of said bottom wall is the same as the incline of the front edges of said ears.

* * * * *